US008106784B2

(12) United States Patent
Katou et al.

(10) Patent No.: US 8,106,784 B2
(45) Date of Patent: Jan. 31, 2012

(54) COMBINATION SMOKE AND HEAT DETECTOR

(75) Inventors: Tomohiro Katou, Tokyo (JP); Takashi Itou, Tokyo (JP); Kenichi Katou, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 322 days.

(21) Appl. No.: 12/382,388

(22) Filed: Mar. 16, 2009

(65) Prior Publication Data

US 2009/0243835 A1 Oct. 1, 2009

(30) Foreign Application Priority Data

Mar. 31, 2008 (JP) ..... 2008-090021
Mar. 31, 2008 (JP) ..... 2008-090142

(51) Int. Cl.
*G08B 17/00* (2006.01)

(52) U.S. Cl. ..... 340/628; 340/577; 340/584; 340/629; 340/630; 250/554; 250/574

(58) Field of Classification Search ..... 340/628, 340/630
See application file for complete search history.

(56) References Cited

U.S. PATENT DOCUMENTS

| | | | | |
|---|---|---|---|---|
| 6,154,142 | A | 11/2000 | Kosugi et al. | |
| 6,300,876 | B1 * | 10/2001 | Sakurai et al. | 340/630 |
| 2002/0154018 | A1 | 10/2002 | Nishikawa et al. | |
| 2003/0020617 | A1 | 1/2003 | Tice et al. | |
| 2006/0007009 | A1 * | 1/2006 | Hess et al. | 340/628 |

FOREIGN PATENT DOCUMENTS

| | | |
|---|---|---|
| EP | 1 253 566 | 10/2002 |
| GB | 2 343 284 | 5/2000 |
| JP | 8-180273 | 7/1996 |
| JP | 09-091559 | 4/1997 |
| JP | 10-111988 | 4/1998 |
| JP | 2000-137875 | 5/2000 |
| JP | 2001-14570 | 1/2001 |
| JP | 2003-36488 | 2/2003 |
| WO | 01/78031 | 10/2001 |

OTHER PUBLICATIONS

European Search Report issued Jun. 7, 2011 in corresponding European Patent Application No. 09250786.2.
Partial European Search Report (in English language) issued Feb. 8, 2011 in corresponding European Patent Application No. 09 25 0786.

* cited by examiner

*Primary Examiner* — George Bugg
*Assistant Examiner* — Ojiako Nwugo
(74) *Attorney, Agent, or Firm* — Wenderoth, Lind & Ponack, LLP

(57) ABSTRACT

A combination smoke and heat detector which allows, in spite of a simple structure, light emitted from an indication lamp to be visually confirmed from a wide range of directions. The combination smoke and heat detector (100) includes a body base (10), a printed circuit board (1), a thermosensitive element (2), a dark chamber (3), an indication lamp (4) mounted to the printed circuit board (1), a protective cover (30), and a bar-like light guide (5) for guiding light emitted from the indication lamp (4) to the outside of the protective cover (30). The light guide (5) passes through a light guide through-hole (35) formed in the protective cover (30) so as to be mounted therein, with one end surface thereof facing the indication lamp (4), and another end surface thereof protruding to the outside of the protective cover (30) by a height substantially equal to or larger than a protruding height of the dark chamber (3). Further, the light guide (5) is arranged opposite relative to the thermosensitive element (2), with the dark chamber (3) being sandwiched therebetween.

7 Claims, 12 Drawing Sheets

D-D CROSS SECTION (a)

(b)

(c)

COMBINATION SMOKE AND HEAT DETECTOR

BACKGROUND OF THE INVENTION

1. Field of the Invention

The present invention relates to a combination smoke and heat detector.

2. Description of the Related Art

Conventionally, a combination smoke and heat detector is normally installed on an indoor ceiling and the like, and includes a temperature detection means for detecting air temperature, a smoke detection means for detecting smoke in the air, and a determination means for determining whether or not a fire has occurred on the basis of the detection results of those means. Further, the combination smoke and heat detector includes an "indication lamp" that blinks to indicate that the combination smoke and heat detector is in a normal operational state, or lights up to indicate that the combination smoke and heat detector has detected the occurrence of a fire.

In the combination smoke and heat detector, a printed circuit board which is provided with the determination means is mounted in a cylindrical body base. The printed circuit board is provided with the temperature detection means and the smoke detection means. The temperature detection means includes a thermosensitive element such as a thermistor, and detects temperature at the leading end thereof. The smoke detection means includes light-emitting elements and light-receiving elements arranged in a dark chamber, and detects the presence/absence or the extent of light scattering, which is caused by smoke particles. The dark chamber is mounted to the printed circuit board, and surrounded by a light-shieldable and ventilatable labyrinth body.

In addition, the printed circuit board is accommodated in a protective cover in which an opening portion for allowing the dark chamber to protrude therein and a through-hole for allowing the thermistor to pass therethrough are formed. The range in which the dark chamber and the thermistor protrude with respect to the protective cover is protected by a protector (refer to pages 3 to 4 and FIG. 1 of Japanese Patent Application Laid-open No. Hei 09-091559, for example).

However, in the invention disclosed in Japanese Patent Application Laid-open No. Hei 09-091559, in the case of mounting the indication lamp (LED chip, for example) to the printed circuit board, even when the protective cover is provided with a visual confirmation window, light emitted from the indication lamp can be visually confirmed only in a particular direction on the straight line coupling the indication lamp and the protective cover with each other, and cannot be visually confirmed out of the direction. Thus, there are problems of inconvenience and rise in cost due to increases in the number of components and in structural complexity.

Meanwhile, even when the indication lamp is raised up (separated) from the printed circuit board so as to partially protrude from a through-hole formed in the protective cover, light emitted from the indication lamp is shielded by the dark chamber protruding from the protective cover. As a result, the direction in which the light can be visually confirmed is limited, which leads to inconvenience.

Further, in the invention disclosed in Japanese Patent Application Laid-open No. Hei 09-091559, although the thermistor protrudes from the protective cover 30, the protruding side thereof is covered with the protector. In addition, although a vent hole is formed at a position of the protector, which corresponds to the thermistor, only a part of the air (including smoke) flowing along the surface of the protector intrudes into the vent hole, and most of the air flows along the surface of the protector without intruding into the vent hole. Thus, it is difficult to capture air (thermal currents) from the direction in which the dark chamber is sandwiched, and there is a problem that the temperature of the air, as described above, cannot be satisfactorily measured.

SUMMARY OF THE INVENTION

The present invention has been made for the purpose of solving the above-mentioned problems, and it is therefore an object of the present invention to provide a combination smoke and heat detector which allows, in spite of a simple structure, light emitted from an indication lamp to be visually confirmed from a wide range of directions.

Further, it is also an object of the present invention to provide a combination smoke and heat detector capable of protecting a thermosensitive element from being damaged and of reliably detecting the temperature of ambient air by effectively capturing the thermal currents from the entire circumferential direction with the use of the thermosensitive element.

(1) The present invention includes:

a body base;

a printed circuit board mounted to the body base;

a thermosensitive element provided upright on the printed circuit board;

a dark chamber mounted to the printed circuit board, for shielding external light so that smoke particles flow therein;

an indication lamp mounted to the printed circuit board;

a protective cover which is provided with respective opening holes through which the thermosensitive element and the dark chamber pass, and engaged with the body base; and a bar-like light guide for guiding light emitted from the indication lamp to outside of the protective cover, in which:

the light guide passes through a through-hole formed in the protective cover so as to be mounted in the through-hole, with one end surface thereof being faced with the indication lamp, and another end surface thereof protruding to the outside of the protective cover by a height substantially equal to or larger than a protruding height of the dark chamber; and the light guide is arranged oppositely to the thermosensitive element, with the dark chamber being sandwiched therebetween.

(2) In Item (1) described above, the protective cover is provided with a cover peripheral surface portion in which the opening portion for allowing the dark chamber to pass therethrough is formed at a center thereof, a cover top surface portion arranged while protruding by a predetermined distance from the cover peripheral surface portion so as to cover the opening portion, and multiple leg portions for coupling the cover top surface portion and the cover peripheral surface portion with each other, and a protruding amount of the another end surface of the light guide from the cover peripheral surface portion is substantially the same as that of the cover top surface portion.

(3) In Item (2) described above, one leg portion of the multiple leg portions communicates with the through-hole so as to be formed on an upper surface of the cover peripheral surface portion, and is provided with a cylindrical portion through which the light guide passes.

(4) Further, the present invention includes:

a body base;

a printed circuit board mounted to the body base;

a thermosensitive element provided upright on the printed circuit board;

a dark chamber mounted to the printed circuit board, for shielding external light so that smoke particles flow therein;

a protective cover which is provided with a cover peripheral surface portion including a thermosensitive element through-hole through which the thermosensitive element passes, and a dark chamber through-hole which is formed at a center of the protective cover and through which the dark chamber passes so as to be arranged on inside thereof, and provided with a cover top surface portion for covering an upper surface of the dark chamber; and a thermosensitive element protector provided upright on both sides of the thermosensitive element while straddling the cover peripheral surface portion and the cover top surface portion, in which:

a leading end of the thermosensitive element is provided at a height by which the leading end of the thermosensitive element protrudes on a lateral side of the dark chamber with respect to the cover top surface portion;

the thermosensitive element protector is constituted by a pair of arch-like members which have substantially an arch-like shape in side view;

the pair of arch-like members are provided with short leg portions which are vertically provided on the cover top surface portion, long leg portions which are vertically provided on the cover peripheral surface portion, and end horizontal portions for coupling with each other end portions of the short leg portions and end portions of the long leg portions;

an interval between the short leg portions becomes gradually larger toward a center of the cover top surface portion; and an interval between the long leg portions becomes gradually smaller toward the center of the cover top surface portion.

(5) In Item (4) described above, a distance between positions of the short leg portions, which are closest to the center of the cover top surface portion, is larger than a distance between positions of the long leg portions, which are farthest from the center of the cover top surface portion.

(6) In Item (4) or (5) described above, on a side of the cover top surface portion of the long leg portions, base horizontal portions vertically provided on the cover peripheral surface portion are formed.

(I-i) The combination smoke and heat detector of the present invention includes the bar-like light guide passing through the protective cover, and one end surface is faced with the indication lamp which is mounted to the printed circuit board, and the other end surface protrudes to the outside of the protective cover by the height substantially equal to or larger than the protruding height of the dark chamber. Therefore, in spite of a simple structure, when installed on the ceiling surface, the dark chamber does not interfere with the visibility, and the light emitted from the indication lamp can be visually confirmed in all directions. Further, the light guide is arranged oppositely to the thermosensitive element while sandwiching the dark chamber, which is arranged at a position farthest from the thermosensitive element. Thus, the thermosensitive element does not interfere with the visibility.

(I-ii) Further, the other end surface of the light guide is substantially flush with the cover top surface portion constituting the protective cover, and hence the light emission of the indication lamp can be visually confirmed from all directions. In addition, the light guide has a height substantially the same as that of the cover top surface portion. Thus, the air flowing along the upper surface of the cover peripheral surface portion flows along the upper surface of the cover top surface portion as it is not obstructed by the light guide, thereby reliably flowing to the thermosensitive element which is opposed thereto while sandwiching the dark chamber therebetween. Therefore, thermal-current capture by the thermosensitive element is not influenced.

(I-iii) Further, the light guide is protected with the cylindrical portion formed in the leg portion, and hence is prevented from being damaged by collision with foreign matter. Still further, the light guide is arranged in proximity to the lateral side of the dark chamber, and an arrangement relationship is established in which objects are less likely to collide therewith.

Further, the combination smoke and heat detector of the present invention has the structure according to Items (4) to (6) described above. Thus, for the following reasons, the combination smoke and heat detector can protect the thermosensitive element from collision with foreign matter and the like, and can reliably detect the temperature of ambient air by, when installed on the ceiling surface, effectively capturing the thermal currents from the entire circumferential direction with use of the thermosensitive element.

(II-i) The leading end of the thermosensitive element is provided at a height by which the leading end thereof protrudes on the lateral side of the dark chamber with respect to the cover top surface portion, that is, the leading end does not hide behind the dark chamber. Thus, the leading end of the thermosensitive element is directly exposed to airflows along the outer surface of the cover top surface portion, and hence it is possible to effectively capture thermal currents from the direction in which the dark chamber is sandwiched therebetween.

(II-ii) The pair of short leg portions has a V-shape in which the short leg portions are widened on the side to the center of the cover top surface portion in plan view. Therefore, the airflows along the outer surface of the cover top surface portion are collected by the pair of short leg portions, and flow effectively to the thermosensitive element.

(II-iii) The pair of long leg portions has an inverted V-shape in which the pair of long leg portions narrows on the side to the center of the cover top surface portion in plan view. Therefore, airflows from the front surface direction of the pair of long leg portions and along the outer surface of the cover peripheral surface portion are collected by the pair of long leg portions, and flow effectively to the thermosensitive element.

(II-iv) The short leg portions and long leg portions of the arch-like members have V-shapes in plan view, with the end horizontal portions are sandwiched therebetween, respectively. Therefore, airflows from the direction in side view and along the outer surface of the cover peripheral surface portion are collected by the short leg portions and the long leg portions of the arch-like members on the upstream side, and flow effectively to the thermosensitive element.

(II-v) Further, the opening degree (distance) of the short leg portions is larger than the opening degree of the long leg portions. Thus, intake of airflows along the outer surface of the cover top surface portion, which constitutes the low sensitive side, is promoted more than intake thereof on the cover peripheral surface portion side. As a result, it is possible to uniformize the sensitive properties in the entire circumferential direction of the thermosensitive element.

(II-vi) The thermosensitive element protector is provided upright on both sides of the thermosensitive element. Thus, the air vertically flowing (ascending) toward the thermosensitive element directly collides with the thermosensitive element, and hence temperature of the air from directly there below can be satisfactorily detected.

(II-vii) The thermosensitive element is surrounded by a member which forms an air duct as described above, that is, by members which are arranged so as to be capable of preventing the intrusion of foreign matter (cleaning tools or fingers, for example), and hence is prevented from being damaged by collision with foreign matter and the like.

(II-viii) Further, on the side of the cover top surface portion of the long leg portions, the base horizontal portions vertically provided on the cover peripheral surface portion are formed. Thus, airflows from the direction in side view and along the outer surface of the cover peripheral surface portion collide with the base horizontal portions, and become descending air currents so as to reach the thermosensitive element. Thus, even when the thermosensitive element has a height by which the thermosensitive element protrudes with respect to the cover top surface portion in side view, the air currents effectively flow to the leading end of the thermistor.

BRIEF DESCRIPTION OF THE DRAWINGS

In the accompanying drawings.

view

DETAILED DESCRIPTION OF THE PREFERRED EMBODIMENTS

In the following, a combination smoke and heat detector according to an embodiment of the present invention is described with reference to the drawings. Note that, in each of the drawings, the same portions are denoted by the same reference symbols, and a part of description is omitted.

Figure 1:
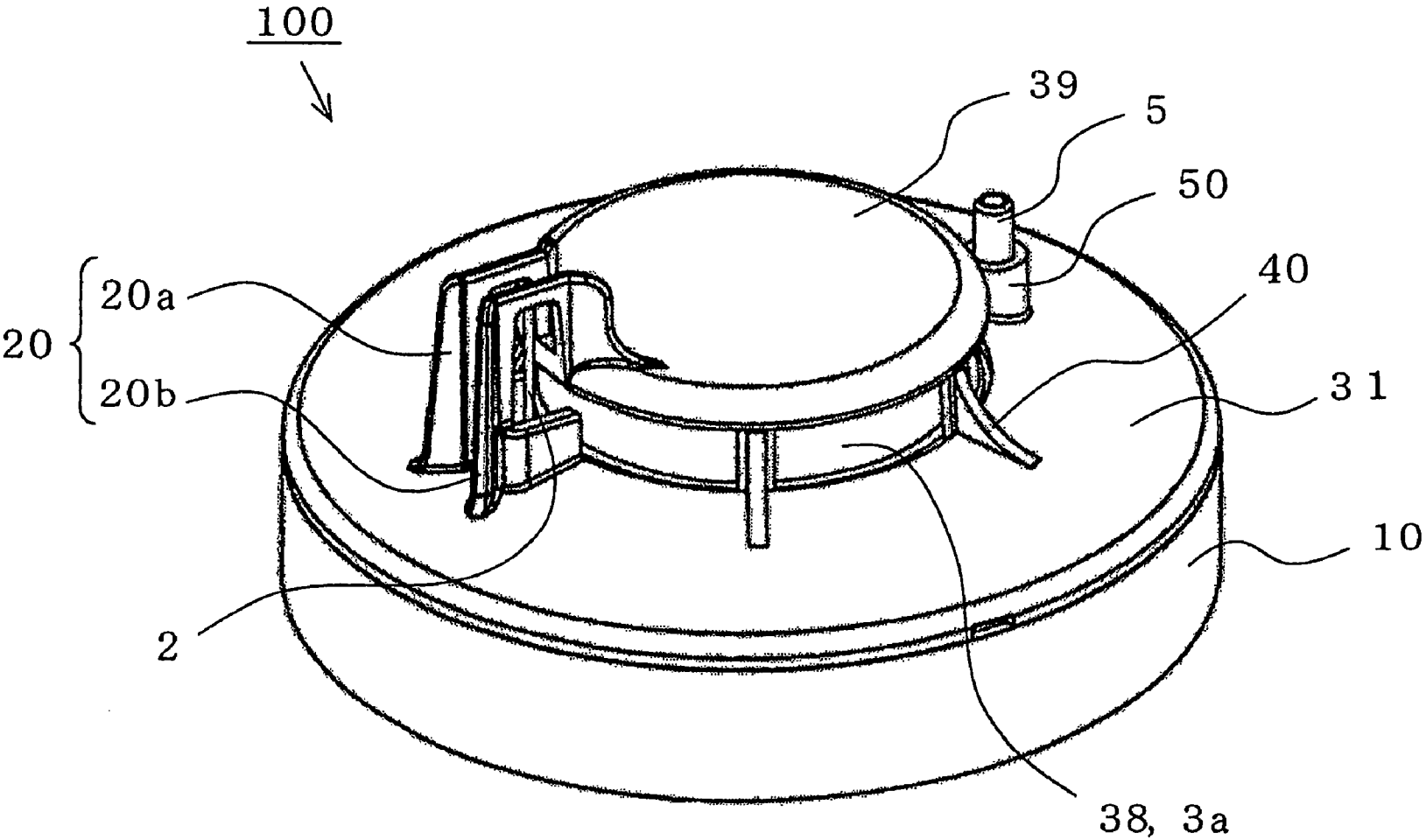
FIG. 1 is an overall perspective view of a combination smoke and heat detector according to an embodiment of the present invention.
Figure 2:
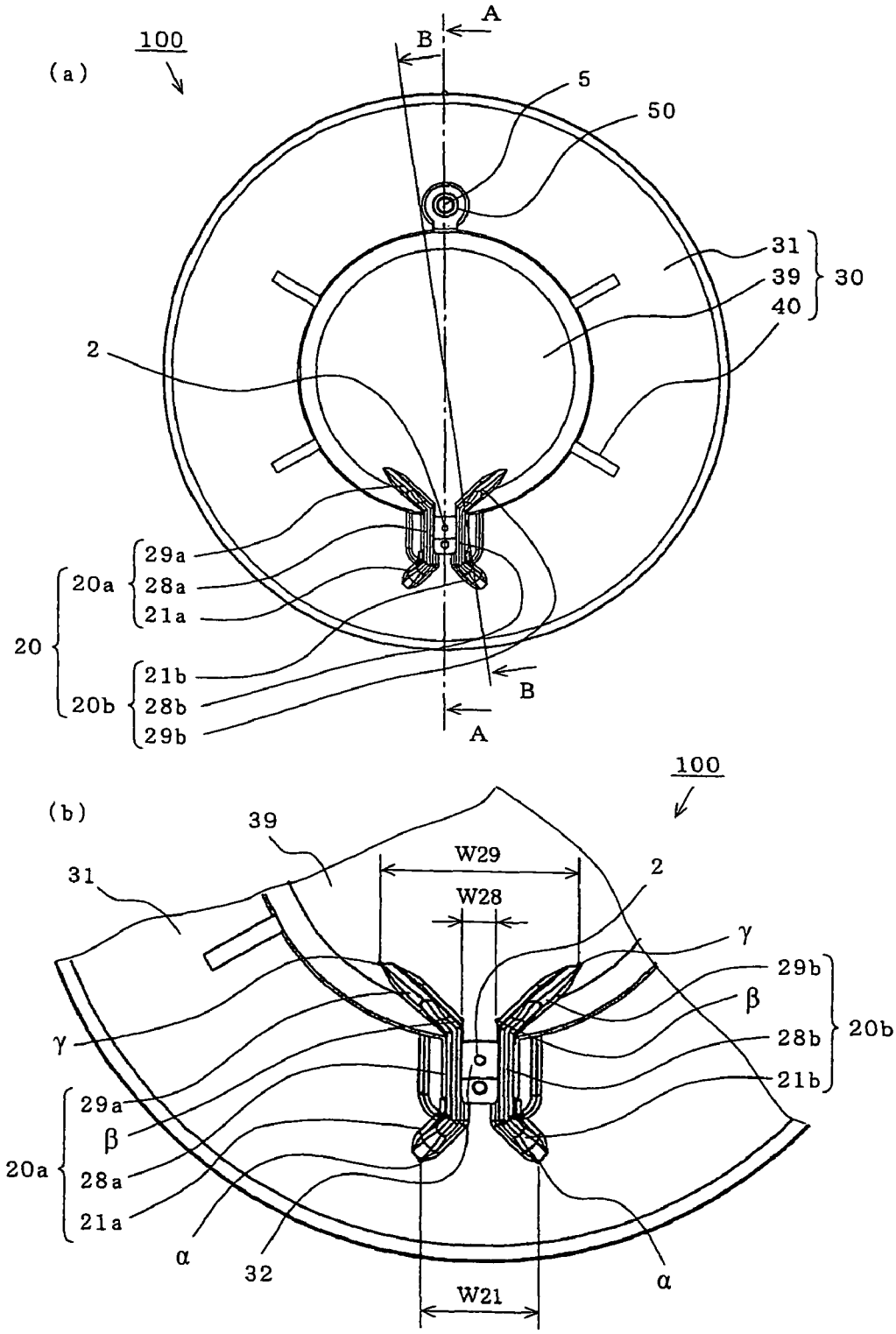
FIG. 2(*a*) is a plan view of the combination smoke and heat detector illustrated in FIG. 1, and FIG. 2(*b*) is an enlarged plan view thereof.
Figure 3:
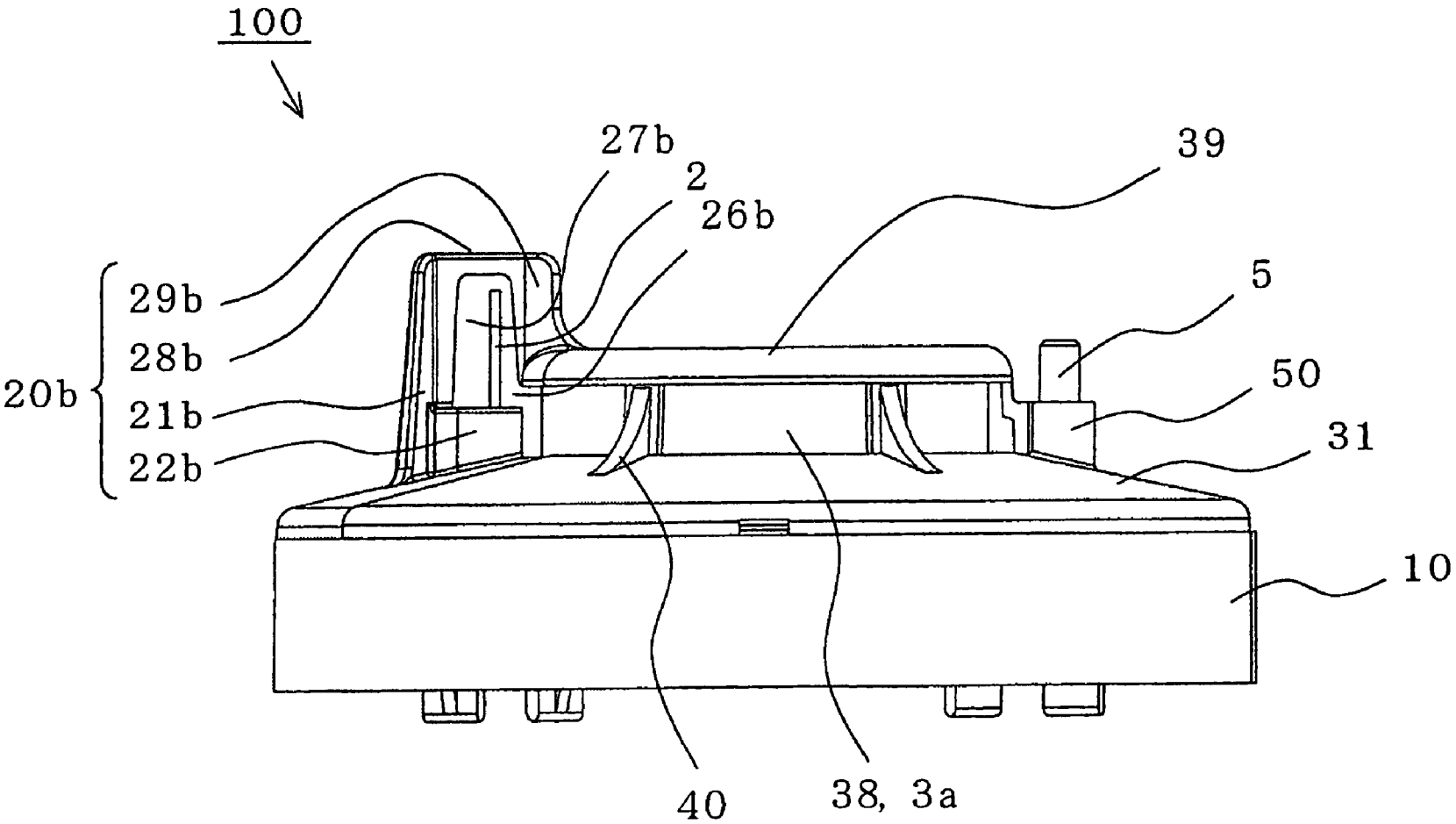
FIG. 3 is a side view of the combination smoke and heat detector illustrated in FIG. 1.
Figure 4:
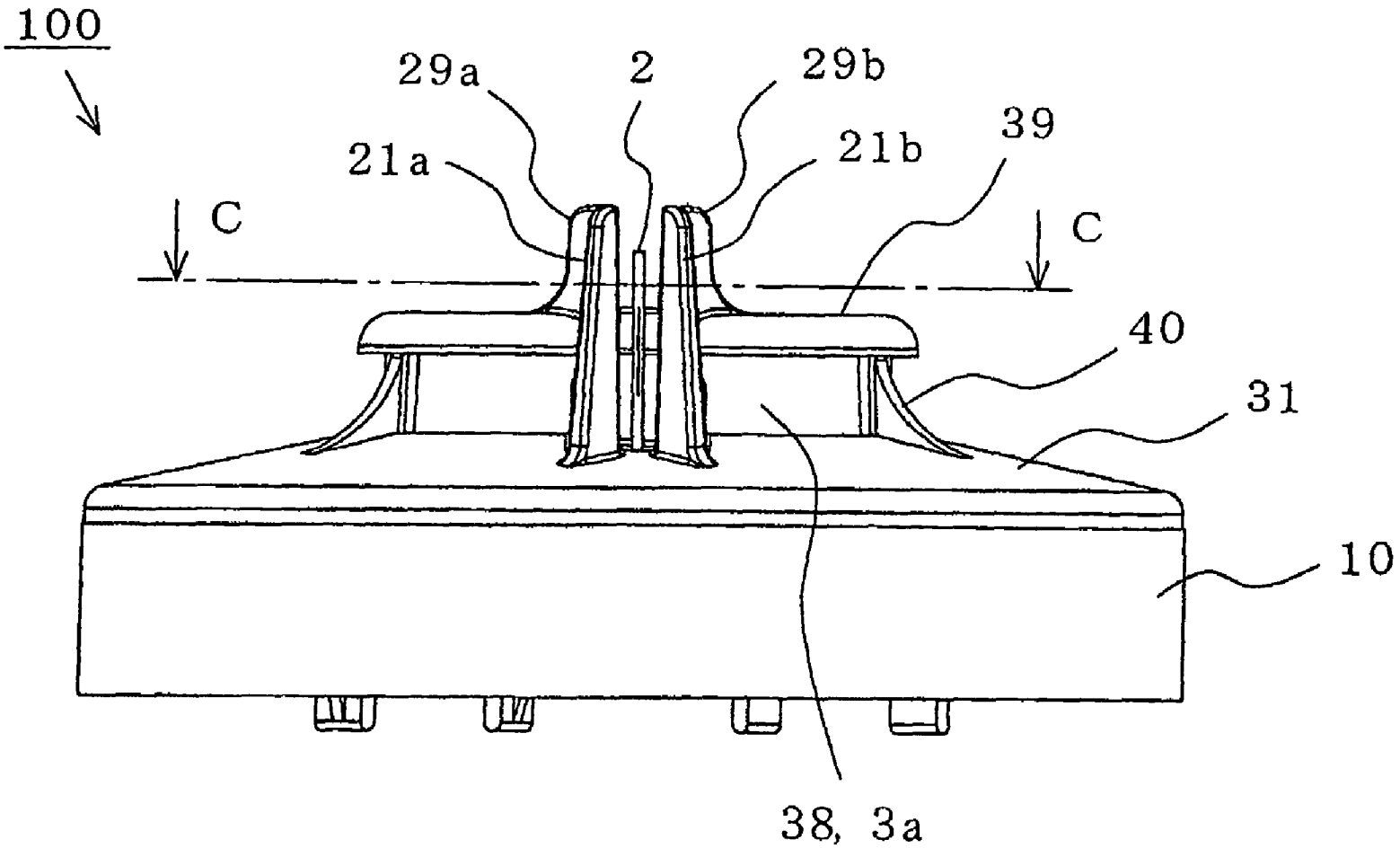
FIG. 4 is a front view of the combination smoke and heat detector illustrated in FIG. 1.
Figure 5:
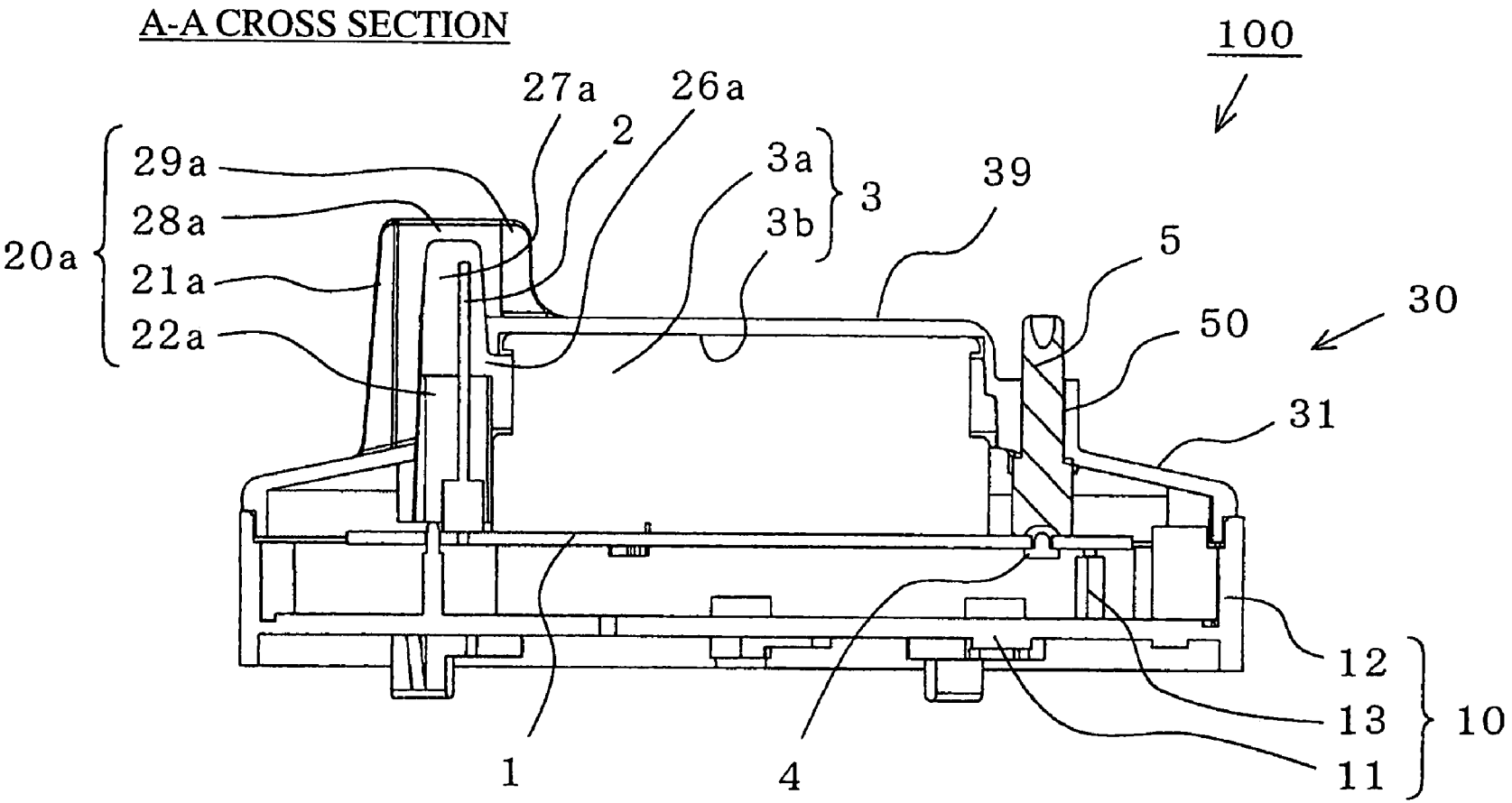
FIG. 5 is a side-sectional view of the combination smoke and heat detector illustrated in FIG. 1.
Figure 6:
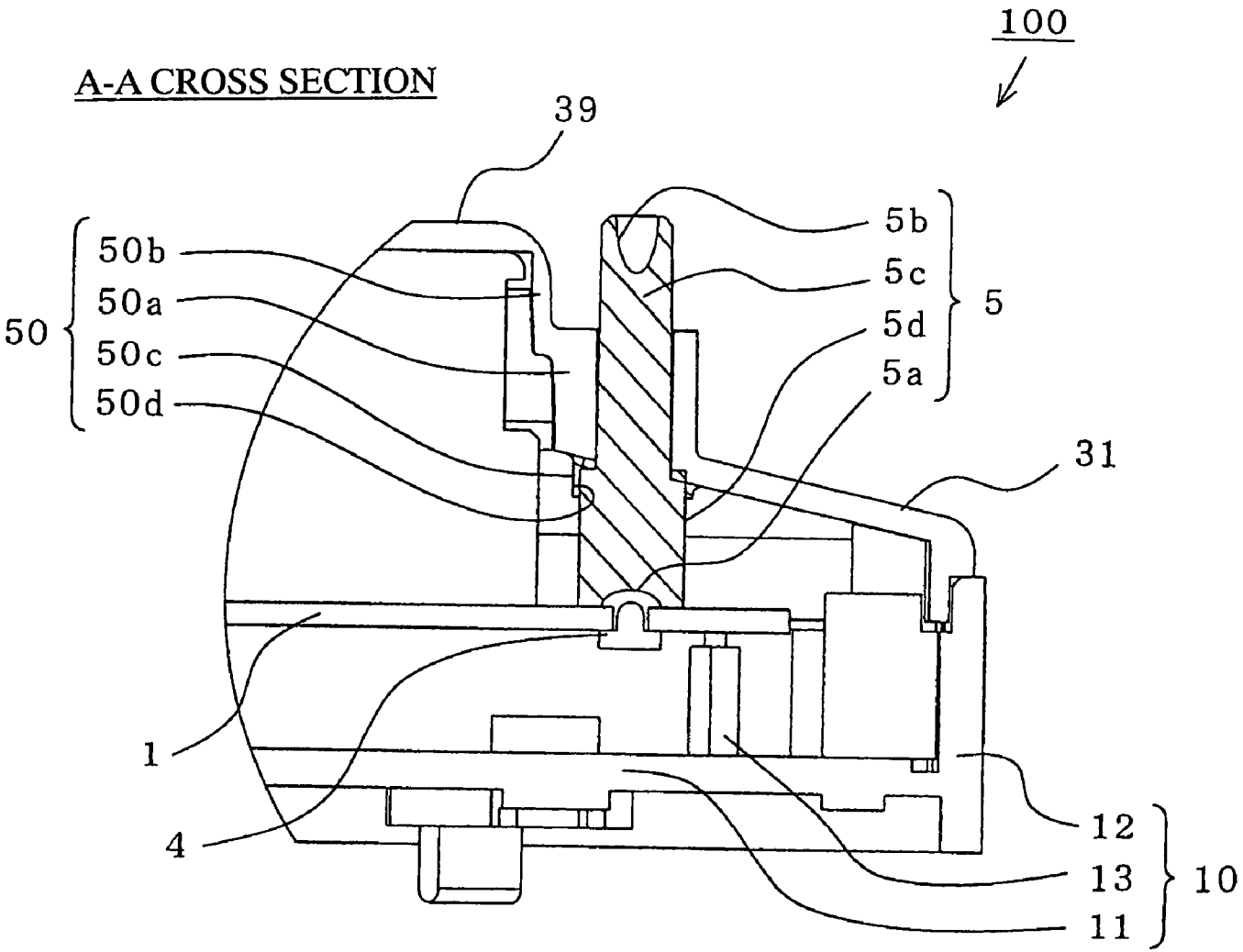
FIG. 6 is an enlarged sectional view of a part of the combination smoke and heat detector illustrated in FIG. 5.
Figure 7:
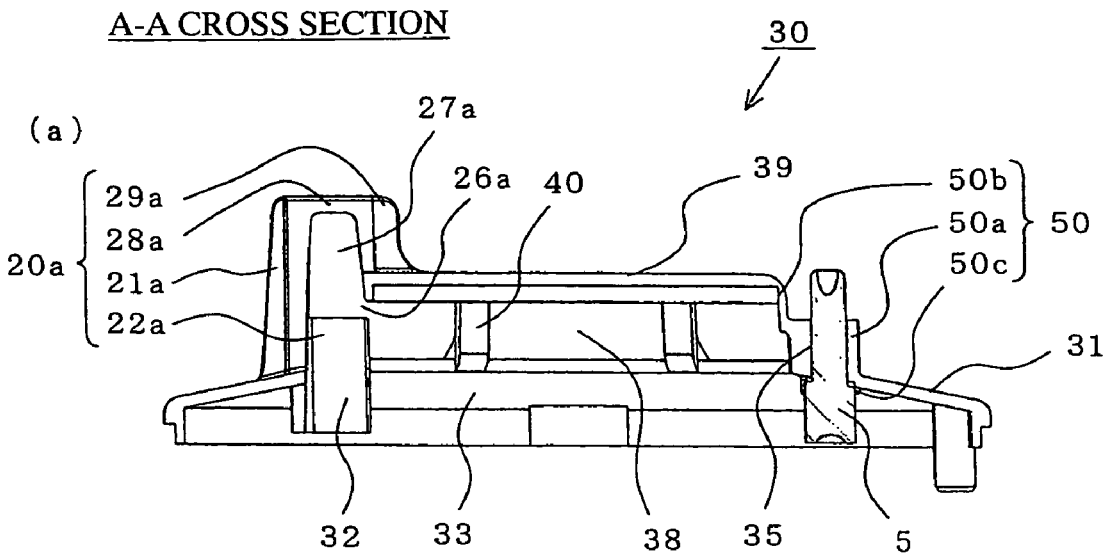
FIGS. 7(*a*) and 7(*b*) are side sectional views illustrating the combination smoke and heat detector illustrated in FIG. 1, which is divided into parts.
Figure 7:
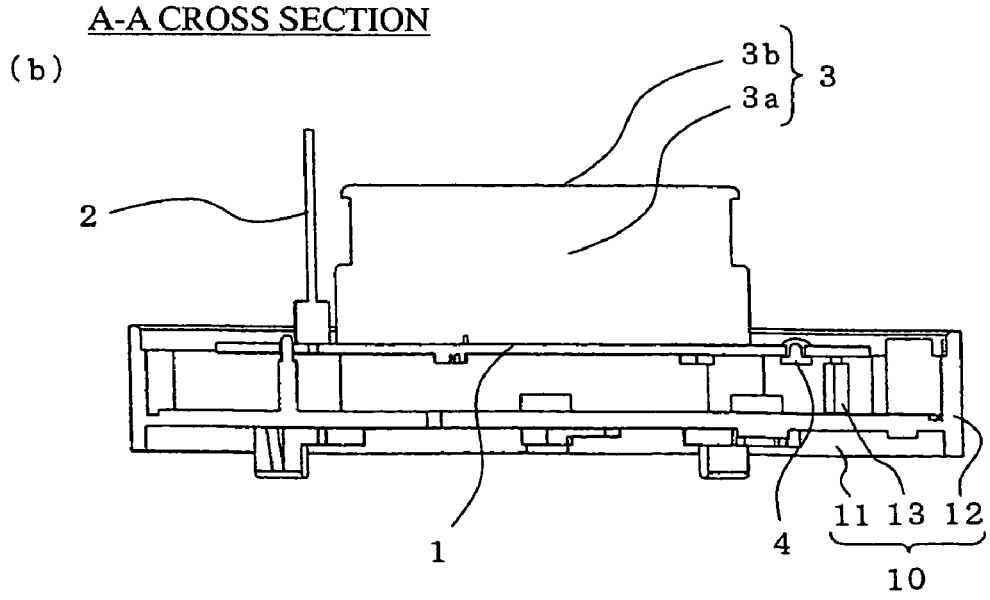
Figure 8:
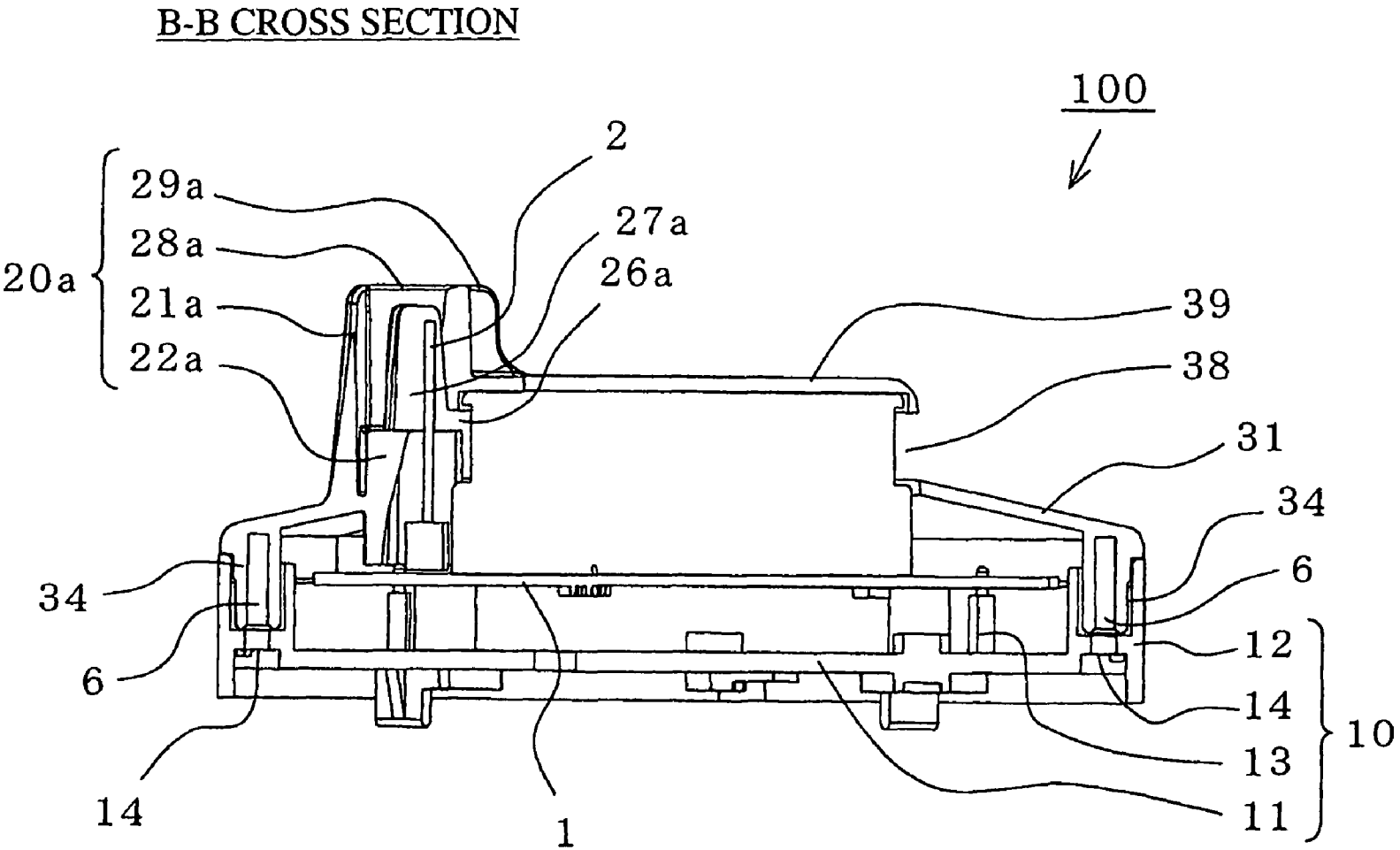
FIG. 8 is a substantially side-sectional view of the combination smoke and heat detector illustrated in FIG. 1.
Figure 9:
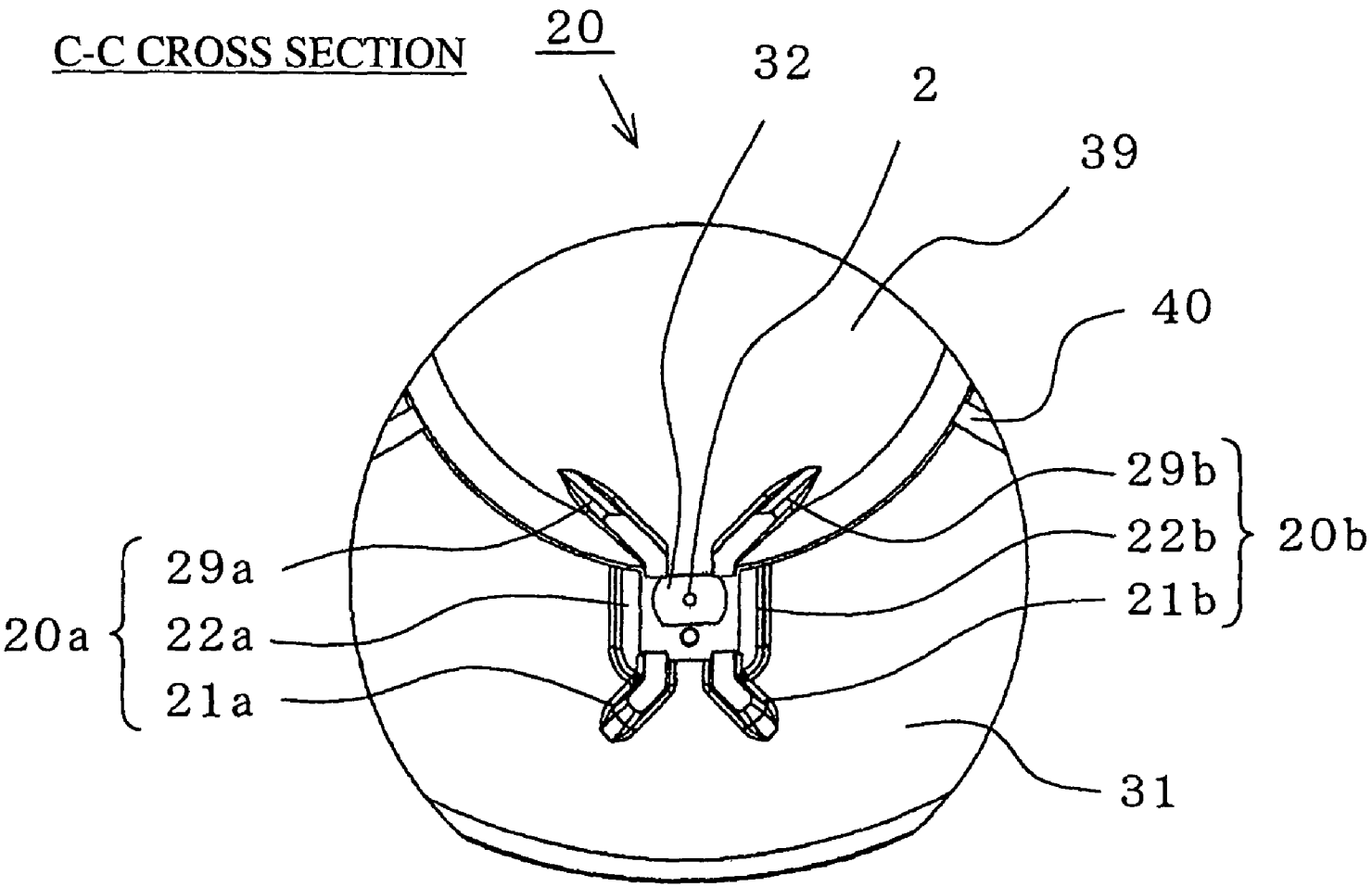
FIG. 9 is a plan sectional view illustrating in an enlarged manner a part of the combination smoke and heat detector illustrated in FIG. 1.

FIGS. 1 to 9 illustrate a combination smoke and heat detector according to embodiments of the present invention. FIG. 1 is a perspective view illustrating the combination smoke and heat detector according to an embodiment of the present invention. FIG. 2(*a*) is a plan view illustrating the combination smoke and heat detector. FIG. 2(*b*) is a partially enlarged plan view thereof. MG 3 is a side view illustrating the combination smoke and heat detector. FIG. 4 is a front view illustrating the combination smoke and heat detector. FIG. 5 is a side sectional view illustrating the combination smoke and heat detector. FIG. 6 is an enlarged sectional view of a part of FIG. 5. FIGS. 7(*a*) and 7(*b*) are side sectional views illustrating divided parts thereof. FIG. 8 is a substantially side-sectional view illustrating the combination smoke and heat detector. FIG. 9 is a plan sectional view illustrating in an enlarged manner a part thereof.

In FIGS. 1 to 9, a combination smoke and heat detector (hereinafter, abbreviated as "detector") 100 includes a body base 10, a printed circuit board 1 mounted to the body base 10, a thermosensitive element 2 provided upright on the printed circuit board 1, light-emitting elements and light-receiving elements (not shown) provided upright on the printed circuit board 1, a dark chamber 3 which is ventilatable and light-shieldable and accommodates the light-emitting elements and the light-receiving elements, an indication lamp 4 mounted on the printed circuit board 1, a protective cover 30, and a bar-like light guide 5 for guiding light emitted from the indication lamp 4 to the outside of the protective cover 30 (refer to FIG. 5).

Note that, while the detector 100 is installed by means of the body base 10 to the indoor ceiling or the like through an intermediation of an attachment base (not shown), the body base 10 is illustrated on the lower side and the protective cover 30 is illustrated on the upper side in the following drawings.

(Body Base)

The body base 10 includes a disk-like body bottom portion 11, a body cylindrical portion 12 having a cylindrical shape and provided upright on the outer periphery of the body bottom portion 11, and a circuit board support portion 13 provided on the body bottom portion 11.

The printed circuit board 1 includes a circuit and electronic components having a determination function for determining the occurrence of a fire on the basis of detection results of the thermosensitive element 2 and detection results of the light-emitting elements and light-receiving elements, a notification function for notifying the determination results, and an operation check function for notifying that the thermosensitive element 2 and the light-emitting elements and light-receiving elements are operating normally. Further, the thermosensitive element 2, the light-emitting elements and light-receiving elements (not shown), and the indication lamp 4 are directly mounted on the printed circuit board 1 (refer to FIG. 7(*b*)).

The thermosensitive element 2 detects air temperature, and is a bar-like thermistor for detecting heat at the leading end thereof, which is provided upright on the lateral side of the dark chamber 3 and is attached to the printed circuit board 1 (hereinafter, refer to thermosensitive element 2 as "thermistor 2").

(Dark Chamber)

The dark chamber 3 accommodates the light-emitting elements and light-receiving elements (not shown) arranged at predetermined intervals on the inside thereof. That is, in order to detect smoke particles that have intruded between the light-emitting elements and the light-receiving elements, the dark chamber 3 shields external light so as to allow the smoke particles alone to flow therein. That is, the dark chamber 3 is mounted to the printed circuit board 1, and includes a substantially cylindrical optics table 3*a* having an opening upper surface and a substantially disk-like optics table cover 3*b* for closing the upper surface of the optics table 3*a*. The optics table 3*a* is formed of a cylindrical labyrinth body in which a large number of light-shielding ribs are arranged in the peripheral portion so as to be light-shieldable and ventilatable. Further, an insect screen (not shown) is installed around the optics table 3*a*.

Further, the light-receiving elements detect scattered light at the time the light emitted from the light-emitting elements is scattered by smoke particles. On the basis of the detection result, the printed circuit board 1 determines the presence of smoke particles, that is, whether or not a fire has occurred. Note that, the present invention does not limit the dark chamber 3 to a detection means for smoke particles.

(Indication Lamp)

The indication lamp 4 is fixed to the printed circuit board 1, and is positioned oppositely relative to the thermistor 2, with the dark chamber 3 sandwiched therebetween. In addition, directly above the indication lamp 4, the lower end surface of the light guide 5 mounted to the protective cover 30 is faced in proximity therewith. (In this regard, detailed description is separately made.)

(Light Guide)

The light guide 5 is formed of a light-transmitting member so as to have a bar-like shape, and guides the light emitted from the indication lamp 4 to the outside of the protective cover 30. In the light guide 5, there is formed a pair of ribs 5*d* facing each other on the side surface on one end surface side of a substantially columnar pole portion 5*c*, and on both the one and the other end surfaces, there are formed substantially spheroidal recessed portions 5*a* and 5*b* (for forming recessed lenses), respectively. (In this regard, detailed description is separately made.)

(Protective Cover)

The protective cover 30 includes a substantially annular cover peripheral surface portion 31, a substantially disk-like cover top surface portion 39, and cover leg portions 40 for coupling the cover peripheral surface portion 31 and the cover top surface portion 39 with each other.

The cover peripheral surface portion 31 includes an outer peripheral edge engaged with the leading end of the body cylindrical portion 12 of the body base 10. Further, in the cover peripheral surface portion 31, there is formed a substantially disk-like dark chamber through-hole (dark chamber opening portion) 33 at the center thereof, through which the dark chamber 3 passes so as to be arranged on the inside thereof. In addition, around the dark chamber through-hole 33, there are formed a substantially disk-like thermistor through-hole (thermistor opening portion) 32 through which the thermistor 2 passes and a substantially disk-like light guide through-hole 35 through which the light guide 5 passes (refer to FIG. 7(*a*)).

In this case, the thermistor through-hole 32 and the light guide through-hole 35 are disposed on opposite sides of dark chamber so that the dark chamber through-hole 33 is sandwiched therebetween.

Further, on the lower surface of the cover peripheral surface portion 31, there is formed a screw stopping boss 34 for fixing the protective cover 30 to the body bottom portion 11, a fixation screw 6 passing through a screw stopping hole 14 which is formed in the body bottom portion 11 (body cylindrical portion 12) is threadedly engaged with a female screw formed on the screw stopping boss 34 (refer to FIG. 8). With this structure, the protective cover 30 and the body base 10 are engaged with (joined to) each other, thereby constituting the case of the detector 100.

The cover top surface portion 39 protrudes above the cover peripheral surface portion 31 by a predetermined distance, and is arranged so as to cover the dark chamber through-hole 33 in plan view, whereby the upper surface of the dark chamber 3 is covered therewith. Further, between the outer peripheral edge of the cover top surface portion 39 and the inner peripheral edge of the dark chamber through-hole 33, there is formed a substantially cylindrical opening portion 38 which serves as a smoke inlet, and through the opening portion 38, smoke (including air) flows into the dark chamber 3.

The cover leg portions 40 are substantially triangular plate members, and the tops thereof are joined to the outer peripheral edge of the cover top surface portion 39, and the bottoms thereof are joined to the upper surface of the cover peripheral surface portion 31. The cover leg portions 40 are arranged radially with respect to the center of the dark chamber 3 (corresponding to the center of dark chamber through-hole 33). Note that, the cover peripheral surface portion 31, the cover top surface portion 39, and the cover leg portions 40 are formed integrally with each other.

Further, there are mounted a light-guide protection leg 50 which constitutes a mode of protecting the light guide 5 while being sandwiched between the cover leg portions 40, and a thermistor protector (thermosensitive-element protector) 20 which constitutes a mode of protecting the thermistor 2 while being positioned opposite relative to the light-guide protection leg 50. In the drawings, the cover leg portions 40, the light-guide protection leg 50, and the thermistor protector 20 are arranged equiangularly (at intervals of 60°) on substantially the same periphery. (Detailed description thereof is separately made.) Note that, the light-guide protection leg 50 and the thermistor protector 20 function as a part of the cover leg portions 40.

(Thermistor Protector)

The thermistor protector (hereinafter, abbreviated as "protector") 20 is constituted by a pair of arch-like members 20*a* and 20*b* which are symmetrically arranged on opposite sides of the thermistor 2, with the thermistor 2 (thermistor through-hole 32) being sandwiched therebetween with respect to the radial direction of the protective cover 30 (direction of the line A-A in FIG. 2(*a*)) in plan view. The thermistor 2 is surrounded by the arch-like members 20*a* and 20*b*. In the following, regarding the common contents, description is made on one of the contents, and in such a case, description of letters "a" and "b" added to the reference numerals is omitted.

The arch-like members 20*a* and 20*b* straddle the cover peripheral surface portion 31 and the cover top surface portion 39 and are formed integrally therewith, and include substantially flat-plate-like long leg portions 21*a* and 21*b* provided upright from the outer peripheral side of the thermistor through-hole 32 of the cover peripheral surface portion 31, substantially flat-plate-like short leg portions 29*a* and 29*b* provided upright from the peripheral edge of the cover top surface portion 39, substantially flat-plate-bar-like end horizontal portions 28*a* and 28*b* for respectively coupling with each other the leading ends of the long leg portions 21*a* and 21*b* and the leading ends of the short leg portions 29*a* and 29*b*, and substantially flat-plate-rectangular base horizontal portions 22*a* and 22*b* provided upright on the cover peripheral surface portion 31 on both sides of the thermistor through-hole 32. The base horizontal portions 22*a* and 22*b* are provided from the inside of the long leg portions 21*a* and 21*b* to the inner peripheral edge of the cover peripheral surface portion 31.

The end horizontal portions 28*a* and 28*b* are arranged in parallel with the radial direction of the protective cover 30 in plan view while being separated from each other to the extent of not preventing airflows into the thermistor 2, and in addition, are arranged at a height by which the end horizontal portions 28*a* and 28*b* protrude with respect to the thermistor 2 in side view.

The long leg portions 21*a* and 21*b* are arranged in an inverted V-shape in plan view so as to become closer to each other toward the thermistor 2 while sandwiching the diameter of the protective cover 30 therebetween (on both sides). Meanwhile, the short leg portions 29*a* and 29*b* are arranged in a V-shape in plan view so as to become closer to each other toward the thermistor 2 while sandwiching the diameter of the protective cover 30 therebetween (refer to FIGS. 2 and 9). That is, the long leg portions 21*a* and 21*b* and the short leg portions 29*a* and 29*b* are arranged radially with respect to the thermistor 2.

Further, in FIG. 2(*b*), a distance W29 between the positions of the short leg portion 29*a* and short leg portion 29*b*, which are closest to the center of the cover top surface portion 39 (each denoted by "γ" in the drawing), is larger than a distance W21 between die positions of the long leg portion 21*a* and long leg portion 21*b*, which are farthest from the center of the cover top surface portion 39 (each denoted by "α" in the drawing). Accordingly, on the assumption that the interval between the end horizontal portion 28*a* and the end horizontal portions 28*b* arranged in parallel with each other is a distance W28, the following relationships are established regarding those distances.

$$W29>W28 \quad (1)$$

$$W21>W28 \quad (2)$$

$$W29>W21 \quad (3)$$

In addition, the base horizontal portions 22*a* and 22*b* are substantially parallel respectively with the end horizontal portions 28*a* and 28*b* in plan view, and form predetermined gaps 26*a* and 26*b* together with the cover top surface portion 39 therebetween in side view. Accordingly, in side view, substantially rectangular spaces 27*a* and 27*b* including the gaps 26*a* and 26*b* are formed by the upper edges of the base horizontal portions 22*a* and 22*b*, the edges of the long leg portions 21*a* and 21*b*, which are closer to the center of the dark chamber 3, the lower edges of the end horizontal portions 28*a* and 28*b*, and the edges of the short leg portions 29*a* and 29*b*, which are farther from the center of the dark chamber 3.

In this case, as illustrated in FIG. 3, the leading end of the thermistor 2 is provided at a height by which the leading end thereof protrudes on the lateral side of the dark chamber 3 with respect to the cover top surface portion 39 in side view. That is, the leading end of the thermistor 2 does not hide behind the dark chamber 3, and hence is directly exposed to airflows along the outer surface of the cover top surface portion 39 (air currents from the upper direction in FIG. 2(*a*)). Thus, it is possible to effectively capture thermal currents from the direction in which the dark chamber 3 of low sensitivity is sandwiched therebetween, and hence it is possible to satisfactorily detect air temperature in that direction. In this case, the pair of short leg portions 29*a* and 29*b* has a V-shape so as to be widened to the central side of the cover top surface portion 39 in plan view. Therefore, the airflows along the outer surface of the cover top surface portion 39 are collected by the pair of short leg portions 29*a* and 29*b*, and flow effectively to the thermistor 2.

That is, regarding the air currents from the upper direction in FIG. 2(*a*), the pair of short leg portions 29*a* and 29*b* are (radially) formed in a V-shape in which the interval therebetween narrows toward the thermistor 2, whereby the air currents are effectively collected and directed to the thermistor 2. Similarly, regarding the air currents from the respective following directions: the lower direction, the left direction, and the right direction in FIG. 2(*a*), the pair of long leg portions 21*a* and 21*b*, the short leg portion 29*a* and long leg portion 21*a*, and the short leg portion 29*b* and long leg portion 21*b* are (radially) formed in a V-shape in which the intervals therebetween narrow toward the thermistor 2, whereby the air currents are effectively collected and directed to the thermistor 2.

Further, the opening degree (distance W29) of the short leg portions 29*a* and 29*b* is larger than the opening degree (distance W21) of the long leg portions 21*a* and 21*b*. Thus, it is possible to capture thermal currents from the direction in which the dark chamber 3 of low sensitivity is sandwiched therebetween, to thereby uniformize the sensitive properties in the entire circumferential direction of the thermistor 2.

Further, the leading end of the thermistor 2 is positioned in proximity with the lower edges of the end horizontal portions 28*a* and 28*b* in side view, and can be visually confirmed through the spaces 27*a* and 27*b*. That is, air (including smoke) flowing from the direction in side view (left-and-right direction in FIG. 2(*a*)) along the outer surface of the cover peripheral surface portion 31 collides with the base horizontal portions 22*a* and 22*b*, and becomes descending air currents so as to reach the leading end of the thermistor 2 after passing the spaces 27*a* and 27*b*. Thus, even when the thermistor 2 has a height by which the thermistor 2 protrudes with respect to the cover top surface portion 39 in side view, the air effectively flows to the leading end of the thermistor 2, and hence temperature of the air can be satisfactorily detected (refer to FIGS. 3, 5, and 7). In this case, in order to minimize the influence on the smoke detection by the base horizontal portions 22*a* and 22*b*, the gaps 26*a* and 26*b* are formed between the base horizontal portions 22*a* and 22*b* and the cover top surface portion 39 in plan view for the purpose of allowing smoke to flow inwardly.

Note that, air (including smoke) from the lower direction in FIG. 2(*a*) flows in the dark chamber 3 after flowing along the outer surface of the cover peripheral surface portion 31, and hence smoke can be satisfactorily detected. Successively, the air descends on the side surface of the dark chamber 3 so as to reach the leading end of the thermistor 2. Thus, without the provision of the base horizontal portions in this direction, the temperature of the air can be satisfactorily detected. That is, in order to minimize the influence on the smoke detection, which is caused by the provision of the base horizontal portions 22*a* and 22*b*, the base horizontal portions 22*a* and 22*b* are provided only on opposite sides of the thermistor through-hole 32.

Further, regarding the air currents from directly therebelow, the leading end of the thermistor 2 is positioned between the end horizontal portions 28*a* and 28*b* in plan view. Thus, the air vertically flowing (ascending) toward the thermistor 2 directly collides with thermistor 2, and hence temperature of the air from directly therebelow can be satisfactorily detected.

Note that, as described above, the arch-like members 20*a* and 20*b* function as a protector for preventing foreign matter and the like from colliding with the thermistor 2 as a matter of course, a function of effectively leading airflows without interference thereof and promoting the detection of the airflows, and a function as legs for coupling the cover peripheral surface portion 31 and the cover top surface portion 39 with each other, and in addition, as a pair of stiff legs. Therefore, the cover top surface portion 39 is suppressed from being deformed and damaged.

(Light-Guide Protection Leg)

The light-guide protection leg 50 includes a protection leg cylindrical portion 50*a* having a cylindrical shape and formed in the upper surface of the cover peripheral surface portion 31 while being communicated with the light guide through-hole 35, a protection leg coupling portion 50*b* for coupling the upper end of the protection leg cylindrical portion 50*a* and the cover top surface portion 39 with each other, rib fitting portions 50*d* formed in the lower surface of the cover peripheral surface portion 31 while being communicated with the light guide through-hole 35 (refer to FIGS. 6 and 7). Note that, the light guide through-hole 35 functions as the light-guide protection leg 50 as well.

Further, the light guide 5 is inserted in the light guide through-hole 35 from the lower surface side of the cover peripheral surface portion 31 so as to pass through the protection leg cylindrical portion 50*a*. In this case, the ribs 5*d* formed on the side surface intrude (which has the same meaning as that of "fit-in") in the rib fit-in portions 50*d* so as to be engaged therewith. Thus, the height of the light guide 5 is accurate, and the upper end of the light guide 5 is positioned at substantially the same height as that of the upper surface of the cover top surface portion 39.

Accordingly, when installed on the ceiling surface, the dark chamber 3 does not interfere with the visibility, and light emitted from the indication lamp 4 can be visually confirmed in a wide range (360°). Further, the light guide 5 is arranged oppositely relative to the thermistor 2 while the dark chamber 3 is sandwiched therebetween, and has a positional relationship in which the thermistor 2 is farthest therefrom. Thus, the thermistor 2 does not interfere with the visibility. Note that, the upper end of the light guide 5 may be positioned at a height so that the light guide 5 protrudes with respect to the upper surface of the cover top surface portion 39. Further, in a case where the protective cover 30 adopts a structure in which the dark chamber 3 is not protected therewith, that is, in a case where the cover top surface portion 39 and the cover leg portions 40 are omitted and only the cover peripheral surface portion 31 constitutes the protective cover 30, it is enough that the upper end of the light guide 5 is positioned at a height substantially the same as that of the upper surface of the dark chamber 3, or at a height at which the light guide 5 protrudes with respect to the upper end surface of the dark chamber 3.

Further, the light guide 5 is protected with the protection leg cylindrical portion 50*a* formed in the light-guide protection leg 50, and hence is prevented from being damaged by collision with foreign matter and the like. Still further, the light guide 5 is arranged in proximity with the lateral side of the dark chamber 3, and an arrangement relationship is established in which objects are less likely to collide therewith.

In addition, the protection leg coupling portion 50*b* is formed so as to be thinner than the protection leg cylindrical portion 50*a*, the protection leg cylindrical portion 50*a* having a requisite minimum height for protecting the light guide 5 from collision with foreign matter and the like, and having the protruding amount from the cover peripheral surface portion 31 smaller than that from the cover top surface portion 39. Accordingly, air (including smoke) flowing along the upper surface of the cover peripheral surface portion 31 is maximally prevented from being obstructed by the light guide 5, the protection leg cylindrical portion 50*a*, and the protection leg coupling portion 50*b*, and is capable of flowing into the dark chamber 3.

Further, the light guide 5 has a height substantially the same as that of the cover top surface portion 39. Thus, air flowing along the upper surface of the cover peripheral surface portion 31 flows along the upper surface of the cover top surface portion 39, without being obstructed by the light guide 5, and reliably to the thermistor 2 which is opposed thereto while sandwiching the dark chamber 3 therebetween. Therefore, the air flowing along the upper surface of the cover peripheral surface portion 31 does not affect thermal-current capture conducted by the thermistor 2.

In addition, the light-guide protection leg 50 has a function of preventing the light guide 5 from being damaged, a function as a part of the cover leg portions 40 for coupling the cover peripheral surface portion 31 and the cover top surface portion 39 with each other, and a function as a stiff leg provided with the protection leg cylindrical portion 50*a*. Therefore, the cover top surface portion 39 is suppressed from being deformed and damaged.

(Installation Mode of Light Guide)

Figure 10:
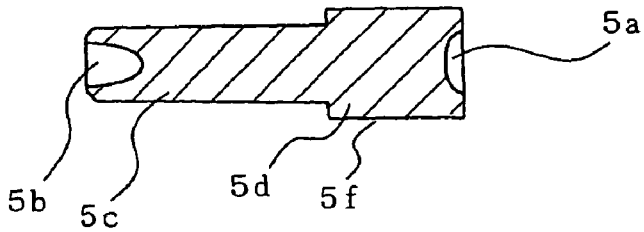
FIG. 10 is a three-way view illustrating an embodiment mode of a light guide of the combination smoke and heat detector illustrated in FIG. 1.
Figure 10:
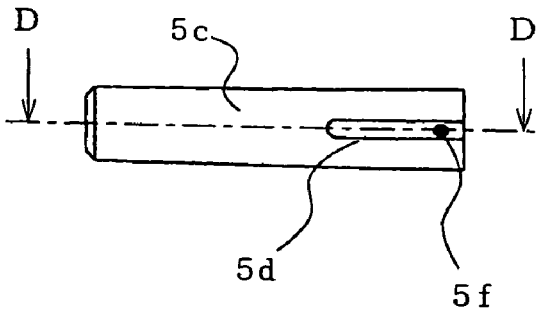
Figure 10:
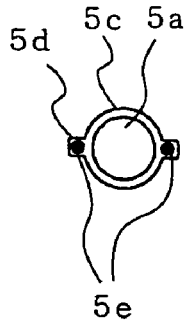
Figure 11:
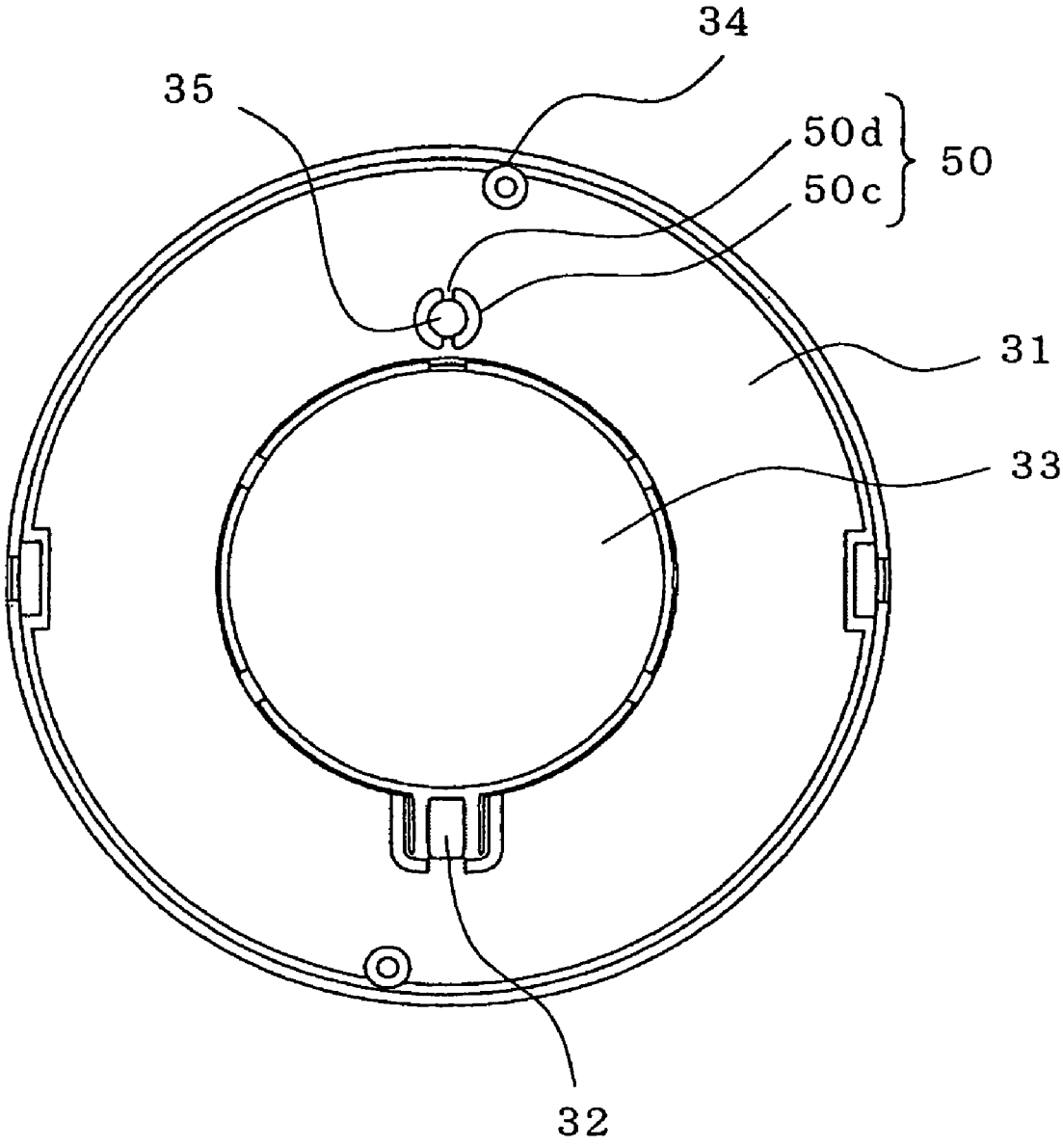
FIG. 11 is a rear view illustrating a cover peripheral surface portion of the combination smoke and heat detector illustrated in FIG. 1.
Figure 12:
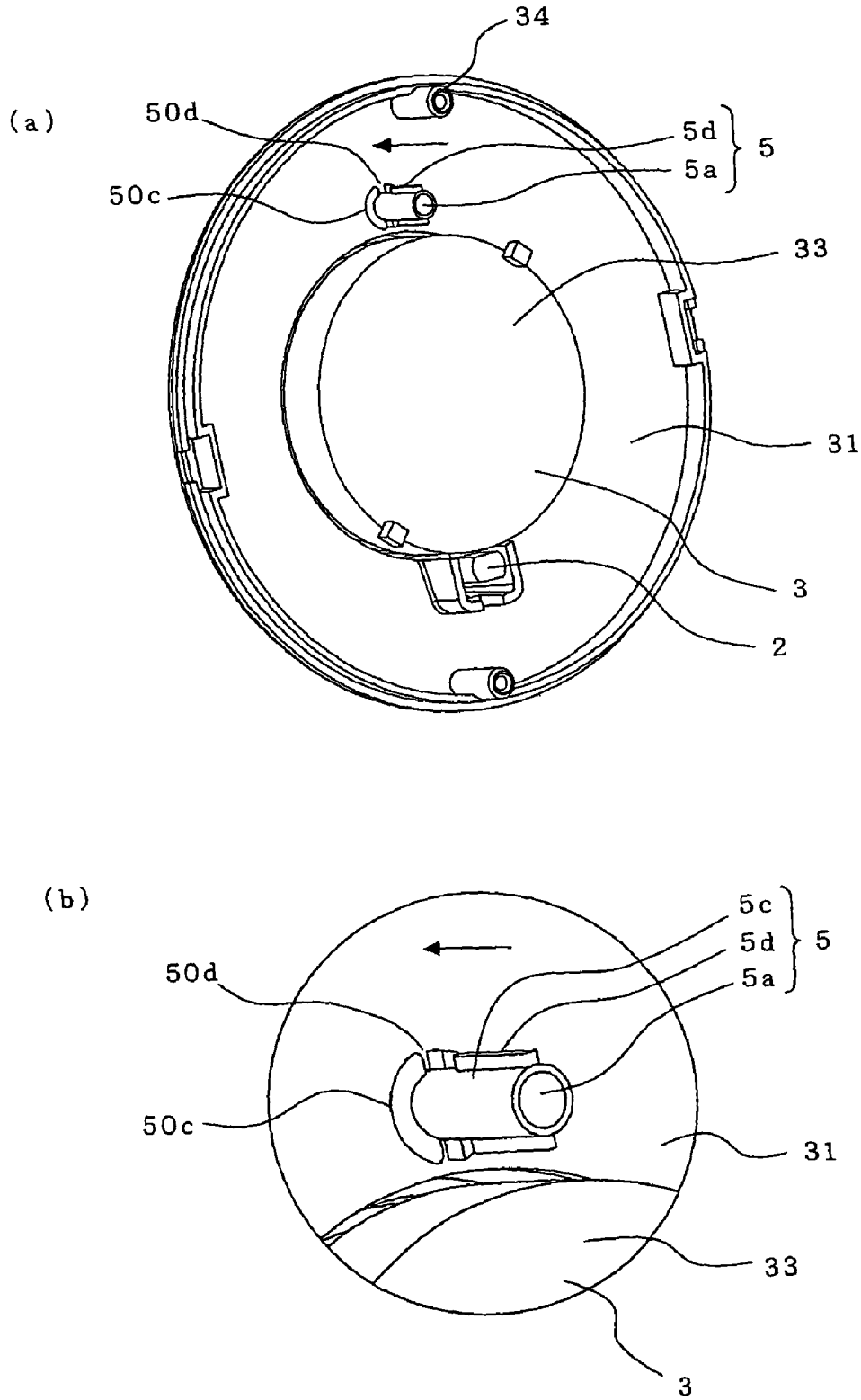
FIGS. 12(*a*) and 12(*b*) are perspective views illustrating an installation mode of the light guide of the combination smoke and heat detector illustrated in FIG. 1.

FIGS. 10 to 12 illustrate an installation mode of the light guide of the combination smoke and heat detector according to an embodiment of the present invention. FIG. 10 is a three-way view illustrating an embodiment mode of the light guide, FIG. 11 is a rear view illustrating the cover peripheral surface portion, and FIGS. 12(*a*) and 12(*b*) are perspective views, illustrating the installation mode of the light guide.

In FIG. 10, the light guide 5 is formed by injection molding of a resin which has translucency (acrylic resin, for example), and light is led through the substantially cylindrical pole portion 5*c*. In the lower end surface on a side protruding downward from the protective cover 30 of the pole portion 5*c* (corresponding to the end surface faced with indication lamp 4), the substantially spheroidal recessed portion 5*a* for increasing light collection properties is formed. In the upper end surface on a side protruding upward from the protective cover 30, the substantially spheroidal recessed portion 5*b* for increasing light scattering properties is formed. On the side surface closer to the lower end surface, the pair of opposed substantially rectangular ribs 5*d* and 5*d* is formed.

Since the recessed portions 5*a* and 5*b* are respectively formed in both the end surfaces of the light guide, light emitted from the indication lamp 4 can be effectively received from the one end surface (recessed portion 5*a*), and the light can be radiated over the wide range from the other end surface (recessed portion 5*b*). Therefore, the indication lamp 4 has high-intensity and is excellent in visibility from a wide range of directions.

Note that, lower end surfaces 5*e* of the ribs 5*d* are positions brought into contact with ejector pins for demolding the light guide 5 after injection molding thereof, and in rib side surfaces 5*f* of the ribs 5*c*1, there are formed injection gates at the time of injection molding. Accordingly, the columnar portion (pole portion 5*c*) through which light is led is maintained to be sound, and light is prevented from being unnecessarily scattered through the side surfaces.

In FIG. 11, on the lower surface of the cover peripheral surface portion 31, there are formed a pair of substantially arcuate light-guide fixation portions 50*c* and 50*c* so as to surround the light guide through-hole 35, gaps between both ends of the light-guide fixation portions 50*c* form the rib fit-in portions 50*d*.

FIG. 12(*a*) illustrates a state immediately before the pole portion 5*c* of the light guide 5 is inserted in the light guide through-hole 35 and the ribs 5*d* are press-fitted into the rib fit-in portions 50*d*.

Note that FIG. 12(*b*) is a partially enlarged view thereof. In the drawing, the arrow indicates a press-fitting direction.

As described above, the combination smoke and heat detector of the present invention allows, in spite of a simple structure, light emitted from an indication lamp to be visually confirmed from a wide range of directions, and hence can be widely used as various combination smoke and heat detector installed in various places.

What is claimed is:

1. A combination smoke and heat detector, comprising:

a body base;

a printed circuit board mounted to the body base;

a thermosensitive element provided upright on the printed circuit board;

a dark chamber, mounted to the printed circuit board, for shielding external light so that smoke particles flow therein;

an indication lamp mounted to the printed circuit board;

a protective cover provided with respective opening holes through which the thermosensitive element and the dark chamber pass, the protective cover being engaged with the body base; and a bar-like light guide for guiding light emitted from the indication lamp to outside of the protective cover, wherein:

the leading end of the thermosensitive element is provided at a height by which the leading end thereof protrudes on a lateral side of the dark chamber with respect to the cover top surface portion;

the light guide passes through a through-hole formed in the protective cover so as to be mounted in the through-hole, with one end surface thereof facing the indication lamp, and another end surface thereof protruding to the outside of the protective cover by a height substantially equal to or larger than a protruding height of the dark chamber; and the light guide is arranged in the protective cover oppositely relative to the thermosensitive element with the dark chamber being sandwiched therebetween.

2. A combination smoke and heat detector according to claim 1, wherein:

the protective cover is provided with a cover peripheral surface portion in which the opening portion for allowing the dark chamber to pass therethrough is formed at a center thereof, a cover top surface portion arranged while protruding by a predetermined distance from the cover peripheral surface portion so as to cover the opening portion, and multiple leg portions for coupling the cover top surface portion and the cover peripheral surface portion with each other; and a protruding amount of the other end surface of the light guide from the cover peripheral surface portion is substantially the same as that of the cover top surface portion.

3. A combination smoke and heat detector according to claim 2, wherein one leg portion of the multiple leg portions communicates with the through-hole so as to be formed on an upper surface of the cover peripheral surface portion, and is provided with a cylindrical portion through which the light guide passes.

4. A combination smoke and heat detector, comprising:

a body base;

a printed circuit board mounted to the body base;

a thermosensitive element provided upright on the printed circuit board;

a dark chamber mounted to the printed circuit board, for shielding external light so that smoke particles flow therein;

a protective cover which is provided with a cover peripheral surface portion including a thermosensitive element through-hole through which the thermosensitive element passes, and a dark chamber through-hole which is formed at a center of the protective cover and through which the dark chamber passes so as to be arranged on inside thereof, and provided with a cover top surface portion for covering an upper surface of the dark chamber; and a thermosensitive element protector provided upright on both sides of the thermosensitive element while straddling the cover peripheral surface portion and the cover top surface portion, wherein:

a leading end of the thermosensitive element is provided at a height by which the leading end of the thermosensitive element protrudes on a lateral side of the dark chamber with respect to the cover top surface portion;

the thermosensitive element protector is constituted by a pair of arch-like members which have substantially an arch-like shape in side view;

the pair of arch-like members are provided with short leg portions which are vertically provided on the cover top surface portion, long leg portions which are vertically provided on the cover peripheral surface portion, and end horizontal portions for coupling with each other end portions of the short leg portions and end portions of the long leg portions;

an interval between the short leg portions becomes gradually larger toward a center of the cover top surface portion; and an interval between the long leg portions becomes gradually smaller toward the center of the cover top surface portion.

5. A combination smoke and heat detector according to claim 4, wherein a distance between positions of the short leg portions, which are closest to the center of the cover top surface portion, is larger than a distance between positions of the long leg portions, which are farthest from the center of the cover top surface portion.

6. A combination smoke and heat detector according to claim 4, wherein, on a side of the cover top surface portion of the long leg portions, base horizontal portions vertically provided on the cover peripheral surface portion are formed.

7. A combination smoke and heat detector according to claim 5, wherein, on a side of the cover top surface portion of the long leg portions, base horizontal portions vertically provided on the cover peripheral surface portion are formed.

* * * * *